US007137446B2

(12) United States Patent
Gagliano et al.

(10) Patent No.: US 7,137,446 B2
(45) Date of Patent: Nov. 21, 2006

(54) FLUIDS COMPRISING REFLECTIVE PARTICLES AND METHODS OF USING THE SAME TO DETERMINE THE SIZE OF A WELLBORE ANNULUS

(75) Inventors: Jesse M. Gagliano, Lafayette, LA (US); William A. Townsend, Wynnewood, OK (US)

(73) Assignee: Halliburton Energy Services Inc., Duncan, OK (US)

( * ) Notice: Subject to any disclaimer, the term of this patent is extended or adjusted under 35 U.S.C. 154(b) by 340 days.

(21) Appl. No.: 10/805,778

(22) Filed: Mar. 22, 2004

(65) Prior Publication Data

US 2005/0205255 A1 Sep. 22, 2005

(51) Int. Cl.
*E21B 33/13* (2006.01)
*E21B 21/00* (2006.01)
*E21B 47/00* (2006.01)

(52) U.S. Cl. ..... 166/250.02; 166/250.12; 175/65

(58) Field of Classification Search ..... 166/250.02, 166/250.12; 175/65
See application file for complete search history.

(56) References Cited

U.S. PATENT DOCUMENTS

| | | | | |
|---|---|---|---|---|
| 3,325,373 | A | 6/1967 | Schlict et al. | 176/39 |
| 4,646,834 | A | 3/1987 | Bannister | 166/291 |
| 4,947,683 | A | 8/1990 | Minear et al. | 73/155 |
| 5,330,005 | A | 7/1994 | Card et al. | 166/280 |
| 5,439,055 | A | 8/1995 | Card et al. | 166/280 |
| 5,501,274 | A | 3/1996 | Nguyen et al. | 166/276 |
| 5,501,275 | A | 3/1996 | Card et al. | 166/280 |
| 5,582,249 | A | 12/1996 | Caveny et al. | 166/276 |
| 5,595,966 | A | 1/1997 | Rees et al. | 508/591 |
| 5,697,440 | A | 12/1997 | Weaver et al. | 166/281 |
| 5,782,300 | A | 7/1998 | James et al. | 166/278 |
| 6,006,831 | A | 12/1999 | Schlemmer et al. | 166/250.01 |
| 6,059,034 | A | 5/2000 | Rickards et al. | 166/280 |
| 6,085,844 | A | 7/2000 | Palmer et al. | 166/312 |
| 6,172,011 | B1 | 1/2001 | Card et al. | 507/204 |
| 6,192,985 | B1 | 2/2001 | Hinkel et al. | 166/280 |
| 6,321,839 | B1 | 11/2001 | Vereecken et al. | 166/250.16 |
| 6,330,916 | B1 | 12/2001 | Rickards et al. | 166/280 |
| 6,364,018 | B1 | 4/2002 | Brannon et al. | 166/280 |
| 6,419,019 | B1 | 7/2002 | Palmer et al. | 166/311 |
| 6,458,198 | B1 | 10/2002 | Baret et al. | 106/644 |
| 6,508,305 | B1 | 1/2003 | Brannon et al. | 166/293 |
| 6,691,780 | B1 * | 2/2004 | Nguyen et al. | 166/254.1 |

FOREIGN PATENT DOCUMENTS

| | | |
|---|---|---|
| EP | 0 278 671 A1 | 2/1988 |
| EP | 1 355 038 A1 | 10/2003 |
| WO | WO 01/81914 A1 | 11/2001 |

OTHER PUBLICATIONS

Foreign communication from a related counterpart application dated Feb. 18, 2005, PCT/ISA/220, filed Dec. 17, 2004.

* cited by examiner

*Primary Examiner*—Frank Tsay
(74) *Attorney, Agent, or Firm*—Craig W. Roddy; Conley Rose, P.C.

(57) ABSTRACT

In embodiments, methods of determining a size of an annulus in a wellbore include: (a) displacing a fluid comprising reflective particles downhole and up through the annulus, wherein the reflective particles make a front end of the fluid visible as it exits the wellbore; (b) determining a total volume of the fluid displaced into the wellbore by detecting the reflective particles exiting the wellbore; and (c) calculating the size of the annulus based on that total volume of the fluid. The fluid may include a drilling fluid, a cement slurry, a spacer fluid, or combinations thereof. The reflective particles may include polymeric beads. In additional embodiments, drilling fluids, spacer fluids, cement slurries and combinations thereof comprise an effective amount of reflective particles to ensure that the fluids are visible when they exit a wellbore.

95 Claims, No Drawings

FLUIDS COMPRISING REFLECTIVE PARTICLES AND METHODS OF USING THE SAME TO DETERMINE THE SIZE OF A WELLBORE ANNULUS

FIELD OF THE INVENTION

The present invention generally relates to well formation, and more particularly to fluids comprising reflective particles to make the fluids visible and methods of using such fluids to determine the size of an annulus of a wellbore.

BACKGROUND OF THE INVENTION

Natural resources such as gas, oil, and water residing in a subterranean formation or zone are usually recovered by drilling a wellbore down to the subterranean formation while circulating a drilling fluid (also known as a drilling mud) through the drill pipe and the drill bit and upwardly through the wellbore to the surface. The drilling fluid serves to lubricate the drill bit and carry drill cuttings back to the surface. After the wellbore is drilled to the desired depth, the drill pipe and drill bit are typically withdrawn from the wellbore while the drilling fluid is left in the wellbore to provide hydrostatic pressure on the formation penetrated by the wellbore and thereby prevent formation fluids from flowing into the wellbore.

The next operation in completing the wellbore usually involves running a string of pipe, e.g., casing, in the wellbore. Primary cementing is then typically performed whereby a cement slurry is pumped down through the string of pipe and into the annulus between the string of pipe and the walls of the wellbore to allow the cement slurry to set into a hard mass (i.e., sheath), and thereby seal the annulus. The cement slurry ideally displaces the drilling fluid from the annulus. However, certain cement slurries are often incompatible with the components in the drilling fluid. For example, it is known in the art that when a cement slurry containing free polyvalent metal cations, especially calcium, are brought into contact with a drilling fluid containing clay or certain polymers, a highly viscous plug can form near the interface of the drilling fluid and cement slurry, creating problems well known in the art. Also, high density drilling fluids commonly contain lignins as dispersants that can lead to excessive retardation in cement slurries. To overcome such problems, a technique has been developed in which a spacer fluid is injected into the wellbore between the drilling fluid and the cement slurry. The spacer fluid is usually compatible with both types of fluids, and it has a density sufficient to displace the drilling fluid from the wellbore.

During drilling, the wellbore may experience washout in which its hole size becomes enlarged. As a result, the actual size of the annulus may be unknown by the time the cement slurry is pumped therein, making it difficult to know when a sufficient amount of cement slurry to fill the annulus has been pumped into the wellbore. One way that can be used to determine the appropriate time to stop pumping the cement slurry into the wellbore is to identify when the cement slurry returns to the surface of the earth. However, this identification has proven to be a challenge, particularly when performing drilling offshore where cement returns to the sea floor are extremely difficult to confirm. While attempts have been made to recognize such cement returns by placing dyes in the cement shiny, those attempts often have failed. Therefore, a need exists to develop a method for determining the amount of cement slurry required to fill the annulus of a wellbore.

SUMMARY OF THE INVENTION

In embodiments, methods of determining a size of an annulus in a wellbore include: (a) displacing a fluid comprising reflective particles downhole and up through the annulus, wherein the reflective particles make a front end of the fluid visible as it exits the wellbore; (b) determining a volume of the fluid displaced into the wellbore by detecting the reflective particles exiting the wellbore; and (c) calculating the size of the annulus based on the volume of the fluid displaced into the wellbore. The fluid containing the reflective particles passes through one or more conduits before reaching the annulus. Thus, the size of the annulus may be determined by subtracting the volume of each conduit from the volume of fluid pumped into the wellbore. The fluid may include, for example, a drilling fluid, a cement slurry, a spacer fluid, or combinations thereof.

In additional embodiments, methods of servicing a wellbore comprise passing a drilling fluid into the wellbore and subsequently displacing another type of fluid into the wellbore that comprises an effective amount of reflective particles to make a front end of the fluid visible as it exits the wellbore. This fluid may include, for example, a spacer fluid, a cement slurry, or combinations thereof. The fluid passes down through one or more conduits and up through an annulus. As the fluid exits the annulus near the surface of the earth, the particles become visible. As such, the volume of the fluid displaced into the wellbore before the fluid initially exits the wellbore can be determined. Further, the size of the annulus can be determined based on that volume of fluid.

In yet more embodiments, drilling fluids, spacer fluids, cement slurries and combinations thereof comprise an effective amount of reflective particles to ensure that the fluids are visible when they exit a wellbore. The reflective particles may, for example, comprise polymeric beads.

DETAILED DESCRIPTION OF THE PREFERRED EMBODIMENTS

A wellbore may be formed by first drilling the wellbore to a desired depth such that the wellbore penetrates a subterranean formation or zone. A drilling fluid, also known as a drilling mud, may be circulated through the wellbore as it is being drilled. At least one conduit such as a casing may then be placed in the wellbore while leaving a space known as an annulus between the wall of the conduit and the wall of the wellbore. The drilling fluid may then be displaced down through the conduit and up through the annulus one or more times, for example, twice, to clean out the hole. Subsequently, an optional spacer fluid followed by a cement slurry may be conveyed downhole and up through the annulus, thereby displacing the drilling fluid from the wellbore. The cement slurry is allowed to set into a substantially impermeable mass that isolates the wellbore and provides support to the adjacent conduit, e.g., casing.

As mentioned previously, the size of the annulus may change from its original size while preparing the wellbore. For example, the annulus may undergo washout, resulting in an increase in its size. As such, the amount of cement slurry needed to completely seal the annulus may be unknown. To determine the required amount of cement slurry, at least one of the fluids conveyed into the wellbore may include an effective amount of reflective particles to make a front end of the fluid visible as it exits the wellbore near the surface of the earth. Front end refers to an initial or leading edge portion or volume of pumped fluid. The front end may represent, for example, the interface between two successively pumped fluids. Examples of fluids that may contain the reflective particles include the drilling fluid, the spacer fluid, the cement slurry, and combinations thereof. The particles may be dispersed throughout the front end of the fluid or throughout the entire length of the fluid. In an embodiment, the reflective particles are present in a front end of the fluid comprising less than about 10% of the total volume of the fluid, alternatively less than about 5%, or alternatively less than about 1%. In an embodiment, the amount of reflective particles present in the fluid is in the range of from about 10 to about 75 pounds per barrel (ppb), alternatively from about 20 to about 50, or alternatively from about 30 to about 40.

Due to the presence of the reflective particles in the fluid, the front end of the fluid is discernible as it exits the wellbore. Thus, the total volume of the fluid displaced into the wellbore before the front end of the fluid exits the wellbore can be determined. The size of the annulus may then be determined based on that total volume of fluid displaced into the wellbore. That is, the volume of the annulus may be calculated by subtracting the known volume of the one or more conduits through which the fluid passes in the wellbore from that total volume of fluid displaced through the wellbore. The known volume of a conduit includes the volume of the flow passage defined by the conduit (e.g., the bore of the casing, the drill pipe, and/or the casing shoe). In this manner, the amount of cement slurry required to fill the annulus can be determined.

In an embodiment in which the reflective particles are present in the cement slurry, it may not be necessary to calculate the size of the annulus before pumping the cement slurry into the wellbore. Due to the presence of the reflective particles, the cement slurry is visible as it exits the wellbore. Thus, the slurry can be pumped downhole and up through the annulus until the front end is detected returning to the surface of the earth. At this point, the displacement of the cement slurry into the wellbore can be terminated without being concerned that the annulus contains void spaces not filled with the cement slurry. That is, the annulus is most likely substantially filled with the cement slurry.

The wellbore may be onshore or offshore. In an embodiment, the wellbore may be located offshore, and a remote operated vehicle (ROV) may be employed to spot the fluid containing the reflective particles as it reaches the sea floor. Remote operated vehicles for underwater use are well known in the art. In particular, the ROV may include a video camera for allowing people to view the environment near the wellbore entrance/exit at the sea floor. In an alternative embodiment, the wellbore may be located onshore. Operators may be stationed at the wellbore to visually observe when the fluid exits the wellbore. Alternatively, at least one video camera may be mounted near the wellbore and positioned such that the wellbore entrance/exit is within its view to visually observe when the fluid exits the wellbore. In an embodiment, the reflective particles are of a type and present in sufficient quantity that they are readily detected visually on a black and white or color monitor video feed from an ROV operating in turbid water.

The aforementioned reflective particles include a material that exhibits a reflectivity of light and that remains inert in the fluid in which it is contained, particularly when it contacts materials downhole such as rock. For example, the reflective particles may include reflective polymeric beads such as the FDP-C691-03 beads sold by Halliburton, Inc. As used herein, a bead is defined as a substantially hollow object filled with gas that is usually spherical in shape. The FDP-C691-03 beads are comprised of from about 0% to about 1% styrene, from about 2% to about 13% proprietary isoparaffins, and from about 60% to about 100% of a copolymer of divinylbenzene, ethylvinylbenzene, and vinylbenzene, all percentages being by weight of the total bead composition. Examples of reflective particles include glitter, sequins, confetti, metallic flakes, glass spheres, metallic or non-metallic micas, bismuth oxychloride, guanines (i.e., fish scales), coated particulate substrates, polymeric flakes (e.g. mylar), polymeric spheres (e.g., polystyrene spheres), polymeric film pieces, ribbons, or tape, and combinations thereof. Reflective coatings include phosphorus coatings, metal coatings (e.g., Al coatings), metal oxide coatings (e.g., $TiO_2$ and $ZrO_2$ coatings). In an embodiment, the beads may have a diameter of about 1 mm, thus ensuring that the beads are visible and that they will not plug any tools downhole.

According to an embodiment, the reflective particles may be used in combination with specific types or wavelengths of light that are effective to enhance the reflectivity of the particles, the ability to detect the reflective particles, or both. For example, an infrared, ultraviolet, or florescent light source may be combined with reflective particles having enhanced reflectivity to such light. Furthermore, corresponding means for detecting and/or characterizing such reflected light may be used, including for example filters and wavelength characterization or analysis means.

In an embodiment, the reflective beads are present in the drilling fluid. Examples of suitable drilling fluids include water-based drilling fluids, oil-based drilling fluids, emulsions, and combinations thereof, all of which are known in the art. Various additives as deemed appropriate by one skilled in the art may be combined with the drilling fluid to improve or alter the properties thereof. For example, the drilling fluid may contain a weighting agent to increase its density and a suspension agent to impart the ability to suspend such weighting agents and other materials in the fluid. Modified clays, which are commonly referred to as organophilic clays, may be used as suspension agents in oil-based drilling fluids. Such clays are usually composed of bentonite or hectorite clays that have been treated with quaternary amine salts or other amine compounds to allow them to swell and function in oil-based environments.

In an embodiment, the reflective particles are present in at least one spacer fluid. As used herein, "spacer fluid" refers to a fluid injected into the wellbore after the injection of the drilling fluid and before the injection of the cement slurry, wherein the spacer fluid is usually compatible with both the drilling fluid and the cement slurry. In an embodiment, the spacer fluid has a density sufficient to displace the drilling fluid from the wellbore. While one spacer fluid is typically displaced into the wellbore, it is understood that more than one spacer fluid may be used. For example, a spacer fluid comprising water and the reflective particles may be pumped into the wellbore, followed by pumping a spacer fluid comprising at least one weighting agent into the wellbore to act as a fluid piston for displacing the drilling fluid. Spacer fluids suitable for displacing the drilling fluid are disclosed in U.S. Pat. No. 4,646,834, which is incorporated by reference herein in its entirety.

In an embodiment, the reflective particles are present in the cement slurry. Suitable cement slurries comprise hydraulic cement, which is well known in the art. Hydraulic cement includes various species that set and harden by reaction with water, such as calcium, aluminum, silicon, oxygen, sulfur, or combinations thereof. Examples of hydraulic cements include Portland cements, pozzolanic cements, gypsum cements, high alumina content cements, silica cements, high alkalinity cements, and combinations thereof. A sufficient amount of fluid is combined with the cement to form a pumpable cementitious slurry. The fluid may be fresh water or salt water, e.g., an unsaturated aqueous salt solution or a saturated aqueous salt solution such as brine or seawater. As deemed appropriate by one skilled in the art, additional additives may be combined with the cement slurry for improving or changing its properties. Examples of such additives include set retarders, fluid loss control additives, weighting agents, dispersing agents, set accelerators, and formation conditioning agents.

The reflective particles may be combined with a fluid for use in a wellbore by, for example, introducing the reflective particles to the fluid through a hopper. The reflective particles and the fluid may then be blended together such that the reflective particles are substantially distributed throughout the fluid. After the reflective particles and the fluid have been blended, they may be continuously agitated before being displaced into the wellbore to ensure that the particles remain distributed throughout the fluid and do not stratify within the fluid.

EXAMPLES

The invention having been generally described, the following examples are given as particular embodiments of the invention and to demonstrate the practice and advantages thereof. It is understood that the examples are given by way of illustration and are not intended to limit the specification or the claims to follow in any manner.

The following procedure was followed to determine the volumes of two different wellbores by using tracer beads, i.e., reflective particles, dispersed in a water-based drilling mud. First, a predetermined amount of a water-based drilling mud obtained from M-I L.L.C. was placed in a pit. The FDP-C691-03 polymeric tracer beads were then sheared through a hopper and added to the drilling mud while constantly agitating the fluid by operating paddles in the pit. This agitation ensured that the beads did not float to the top and kept them suspended in the fluid. Next, the drilling mud followed by a spacer fluid and then a cement slurry were pumped in a wellbore through a drill pipe, an upper casing, a lower casing, a casing shoe, and the annulus of the wellbore back to the sea floor. An ROV positioned at the sea floor was then used to detect when the beads reached the sea floor by watching the ROV monitor. The total volume of the drilling mud, the spacer fluid, and the cement slurry pumped through the wellbore before the beads were detected was determined. The volume of the annulus was then determined by subtracting the known volumes of the drill pipe, the casings, and the casing shoe from the total volume of fluids pumped. Table 1 below provides the total volume of fluids pumped through the wellbore and the calculated annulus volume.

TABLE 1

| | Run No. | |
|---|---|---|
| | 1 | 2 |
| Total Volume of Fluids Pumped | 550 barrels | 1,575 barrels |
| Actual Volume of the Annulus | 295.2 barrels | 1,201.2 barrels |

While preferred embodiments of the invention have been shown and described, modifications thereof can be made by one skilled in the art without departing from the spirit and teachings of the invention. The embodiments described herein are exemplary only, and are not intended to be limiting. Many variations and modifications of the invention disclosed herein are possible and are within the scope of the invention. Use of the term "optionally" with respect to any element of a claim is intended to mean that the subject element is required, or alternatively, is not required. Both alternatives are intended to be within the scope of the claim.

Accordingly, the scope of protection is not limited by the description set out above but is only limited by the claims which follow, that scope including all equivalents of the subject matter of the claims. Each and every claim is incorporated into the specification as an embodiment of the present invention. Thus, the claims are a further description and are an addition to the preferred embodiments of the present invention. The discussion of a reference in the Description of Related Art is not an admission that it is prior art to the present invention, especially any reference that may have a publication date after the priority date of this application. The disclosures of all patents, patent applications, and publications cited herein are hereby incorporated by reference, to the extent that they provide exemplary, procedural or other details supplementary to those set forth herein.

What is claimed is:

1. A method of determining a size of an annulus in a wellbore, comprising: (a) displacing a fluid downhole arid up through the annulus, wherein the fluid comprises reflective particles that make a front end of the fluid visible as it exits the wellbore; and (b) determining a total volume of the fluid displaced into the wellbore by detecting the reflective particles exiting the wellbore; and (c) calculating the size of the annulus based on the total volume of the fluid.

2. The method of claim 1, wherein the fluid comprises a drilling fluid, a spacer fluid, a cement slurry, or combinations thereof.

3. The method of claim 1, wherein the fluid passes through one or more conduits before reaching the annulus.

4. The method of claim 3, wherein step (c) comprises subtracting the volume of each conduit from the volume of fluid.

5. The method of claim 1, wherein the reflective particles comprise glitter, sequins, confetti, metallic flakes, glass spheres, micas, bismuth oxychloride, guanines, coated particulate substrates, polymeric flakes, polymeric spheres, polymeric film, or combinations thereof.

6. The method of claim 5, wherein the coated particulate substrates comprise reflective coatings selected from the group consisting of phosphorus coatings, metal coatings, metal oxide coatings, and combinations thereof.

7. The method of claim 1, wherein the reflective particles comprise beads.

8. The method of claim 1, wherein the reflective particles comprise polymeric beads.

9. The method of claim 1, wherein the reflective particles comprise styrene present in an amount of from about 0% to about 1% by weight of the total particle composition, isoparaffins present in an amount of from about 2% to about 13% by weight of the total particle composition, and a copolymer of divinylbenzene, ethylvinylbenzene, and vinylbenzene present in an amount of from about 60% to about 100% by weight of the total particle composition.

10. The method of claim 1, wherein the reflective particles have a sufficient diameter that they are visible and will not plug any downhole tools.

11. The method of claim 1, wherein the reflective particles have a diameter of about 1 mm.

12. The method of claim 1, wherein the reflective particles comprise FDP-C691-3 polymeric beads.

13. The method of claim 1, wherein the reflective particles are present in the fluid in an effective amount to ensure that the front end of the fluid is visible.

14. The method of claim 1, wherein the wellbore is located offshore and the reflective particles are viewed using a remote operated vehicle.

15. The method of claim 1, wherein the wellbore is located onshore.

16. The method of claim 1, further comprising using the size of the annulus to determine an amount of a cement slurry to displace into the wellbore.

17. The method of claim 1, wherein the reflective particles are used in combination with light having a wavelength effective to enhance the reflectivity of the particles, the ability to detect the reflected particles, or both.

18. The method of claim 1, wherein the reflective particles are used in combination with a type of light effective to enhance the reflectivity of the particles, die ability to detect the reflected particles, or both.

19. The method of claim 1, wherein reflective particles are of a type and present in sufficient quantity that they are readily detected visually on a black and white or color monitor video.

20. The method of claim 1, wherein the reflective particles are used in combination with an infrared, ultraviolet, or florescent light source.

21. The method of claim 20, further comprising means for detecting and/or characterizing light reflected from the reflective particles.

22. The method of claim 21, wherein the means for detecting and/or characterizing light comprises filters and wavelength characterization or analysis means.

23. The method of claim 1, wherein the fluid comprises from about 10 to about 75 pounds per barrel of reflective particles.

24. The method of claim 1, further comprising introducing the reflective particles to the fluid through a hopper and blending the particles and the fluid together prior to step (a).

25. The method of claim 1, further comprising agitating the fluid prior to step (a).

26. The method of claim 1, further comprising using a video camera to observe when the fluid exits the wellbore.

27. A method of servicing a wellbore, comprising: (a) passing a drilling fluid into the wellbore; and (b) subsequently displacing another type of fluid into the wellbore, the another type of fluid comprising an effective amount of reflective particles to ensure that a front end of the fluid is visible when it exits the wellbore.

28. The method of claim 27, wherein the another type of fluid comprises a spacer fluid, a cement slurry, or combinations thereof.

29. The method of claim 27, wherein the another type of fluid is displaced down through one or more conduits and up through an annulus.

30. The method of claim 29, further comprising determining a total volume of the another type of fluid displaced into the wellbore by detecting the reflective particles exiting the wellbore.

31. The method of claim 30, further comprising calculating a size of the annulus by subtracting the volume of each conduit from the total volume of the another type of fluid.

32. The method of claim 31, further comprising using the size of the annulus to determine an amount of cement slurry to displace into the wellbore.

33. The method of claim 27, wherein the reflective particles comprise glitter, sequins, confetti, metallic flakes, glass spheres, micas, bismuth oxychloride, guanines, coated particulate substrates, polymeric flakes, polymeric spheres, polymeric film, or combinations thereof.

34. The method of claim 33, wherein the coated particulate substrates comprise reflective coatings selected from the group consisting of phosphorus coatings, metal coatings, metal oxide coatings, and combinations thereof.

35. The method of claim 27, wherein the wellbore is located offshore and the fluid is observed exiting the wellbore using a remote operated vehicle.

36. The method of claim 27, wherein the wellbore is located onshore.

37. The method of claim 27, wherein the reflective particles are used in combination with light having a wavelength effective to enhance the reflectivity of the particles, the ability to detect the reflected particles, or both.

38. The method of claim 27, wherein the reflective particles are used in combination with a type of light effective to enhance the reflectivity of the particles, the ability to detect the reflected particles, or both.

39. The method of claim 27, wherein the reflective particles comprise beads.

40. The method of claim 27, wherein the reflective particles comprise polymeric beads.

41. The method of claim 27, wherein the reflective particles comprise FDP-C691 -03 polymeric beads.

42. The method of claim 27, wherein the reflective particles comprise styrene present in an amount of from about 0% to about 1% by weight of the total particle composition, isoparaffins present in an amount of from about 2% to about 13% by weight of the total particle composition, and a copolymer of divinylbenzene, ethylvinylbenzene, and vinylbenzene present in an amount of from about 60% to about 100% by weight of the total particle composition.

43. The method of claim 27, wherein the reflective particles have a sufficient diameter that they are visible and will not plug any downhole tools.

44. The method of claim 27, wherein the reflective particles have a diameter of about 1 mm.

45. The method of claim 27, wherein the reflective particles are present in the fluid in an effective amount to ensure that the front end of the fluid is visible.

46. The method of claim 27, wherein reflective particles are of a type and present in sufficient quantity that they are readily detected visually on a black and white or color monitor video.

47. The method of claim 27, wherein the reflective particles are used in combination with an infrared, ultraviolet, or florescent light source.

48. The method of claim 47, further comprising means for detecting and/or characterizing light reflected from the reflective particles.

49. The method of claim 48, wherein the means for detecting and/or characterizing light comprises filters and wavelength characterization or analysis means.

50. The method of claim 27, wherein the fluid comprises from about 10 to about 75 pounds per barrel of reflective particles.

51. The method of claim 27, further comprising using a video camera to observe when the fluid exits the wellbore.

52. The method of claim 27, further comprising introducing the reflective particles to the another type of fluid through a hopper and blending them together prior to step (b).

53. The method of claim 27, further comprising agitating the another type of fluid prior to step (b).

54. A wellbore fluid comprising an effective amount of reflective particles to ensure detection upon exiting a wellbore, wherein the fluid comprises a drill fluid, a spacer fluid, a cement slurry, or combinations thereof.

55. The fluid of claim 54, wherein the reflective particles comprise beads.

56. The fluid of claim 54, wherein the reflective particles comprise polymeric beads.

57. The fluid of claim 54, wherein the reflective particles comprise FDP-C691-03 beads.

58. The fluid of claim 54, wherein the reflective particles comprise styrene present in an amount of from about 0% to about 1% by weight of the total particle composition, isoparaffins present in an amount of from about 2% to about 13% by weight of the total particle composition, and a copolymer of divinylbenzene, ethylvinylbenzene, and vinylbenzene present in an amount of from about 60% to about 100% by weight of the total particle composition.

59. The fluid of claim 54, wherein the reflective particles have a sufficient diameter that they are visible and will not plug any downhole tools.

60. The fluid of claim 54, wherein the reflective particles have a diameter of about 1 mm.

61. The fluid of claim 54, wherein the reflective particles comprise glitter, sequins, confetti, metallic flakes, glass spheres, micas, bismuth oxychloride, guanines, coated particulate substrates, polymeric flakes, polymeric spheres, polymeric film, or combinations thereof.

62. The fluid of claim 61, wherein the coated particulate substrates comprise reflective coatings selected from the group consisting of phosphorus coatings, metal coatings, metal oxide coatings, and combinations thereof.

63. The fluid of claim 54, wherein the fluid comprises from about 10 to about 75 pounds per barrel of reflective particles.

64. The fluid of claim 54, wherein the reflective particles are present in the fluid in an effective amount to ensure that the front end of the fluid is visible.

65. The fluid of claim 54, wherein the wellbore is located offshore and the reflective particles are viewed using a remote operated vehicle.

66. The fluid of claim 54, wherein the wellbore is located onshore.

67. The fluid of claim 54, wherein the reflective particles arc used in combination with light having a wavelength effective to enhance the reflectivity of the particles, the ability to detect the reflected particles, or both.

68. The fluid of claim 54, wherein the reflective particles are used in combination with a type of light effective to enhance the reflectivity of the particles, the ability to detect the reflected particles, or both.

69. The fluid of claim 54, wherein reflective particles are of a type and present in sufficient quantity that they are readily detected visually on a black and while or color monitor video.

70. The fluid of claim 54, wherein the reflective particles are observed using a video camera when the fluid exits the wellbore.

71. The fluid of claim 54, wherein the reflective particles are used in combination with an infrared, ultraviolet, or florescent light source.

72. A method of using a fluid in a wellbore, comprising: (a) displacing a fluid comprising reflective particles in the wellbore; and (b) detecting the reflective particles; wherein the fluid passes through one or more conduits before reaching an annulus in the wellbore.

73. The method of claim 72, wherein the fluid comprises a drilling fluid, a spacer fluid, a cement slurry, or combinations thereof.

74. The method of claim 72, wherein the reflective particles comprise glitter, sequins, confetti, metallic flakes, glass spheres, micas, bismuth oxychloride, guanines, coated particulate substrates, polymeric flakes, polymeric spheres, polymeric film, or combinations thereof.

75. The method of claim 74, wherein the coated particulate substrates comprise reflective coatings selected from the group consisting of phosphorus coatings, metal coatings, metal oxide coatings, and combinations thereof.

76. The method of claim 72, wherein the reflective particles comprise beads.

77. The method of claim 72, wherein the reflective particles comprise polymeric beads.

78. The method of claim 72, wherein the reflective particles comprise styrene present in an amount of from about 0% to about 1% by weight of the total particle composition, isoparaffins present in an amount of from about 2% to about 13% by weight of the total particle composition, and a copolymer of divinylbenzene, ethylvinylbenzene, and vinylbenzene present in an amount of from about 60% to about 100% by weight of the total particle composition.

79. The method of claim 72, wherein the reflective particles have a sufficient diameter that they are visible and will not plug any downhole tools.

80. The method of claim 72, wherein the reflective particles have a diameter of about 1 mm.

81. The method of claim 72, wherein the reflective particles comprise FDP-C691-3 polymeric beads.

82. The method of claim 72, wherein the reflective particles are present in the fluid in an effective amount to ensure that the front end of the fluid is visible.

83. The method of claim 72, wherein the wellbore is located offshore and the reflective particles are viewed using a remote operated vehicle.

84. The method of claim 72, wherein the wellbore is located onshore.

85. The method of claim 72, further comprising using the size of the annulus to determine an amount of a cement slurry to displace into the wellbore.

86. The method of claim 72, wherein the reflective particles are used in combination with light having a wavelength effective to enhance the reflectivity of the particles, the ability to detect the reflected particles, or both.

87. The method of claim 72, wherein the reflective particles are used in combination with a type of light effective to enhance the reflectivity of the particles, the ability to detect the reflected particles, or both.

88. The method of claim 72, wherein reflective particles are of a type and present in sufficient quantity that they are readily detected visually on a black and white or color monitor video.

89. The method of claim 72, wherein the reflective particles are used in combination with an infrared, ultraviolet, or florescent light source.

90. The method of claim 89, further comprising means for detecting and/or characterizing light reflected from the reflective particles.

91. The method of claim 90, wherein the means for detecting and/or characterizing light comprises filters and wavelength characterization or analysis means.

92. The method of claim 72, wherein the fluid comprises from about 10 to about 75 pounds per barrel of reflective particles.

93. The method of claim 72, further comprising introducing the reflective particles to the fluid through a hopper and blending the particles and the fluid together prior to step (a).

94. The method of claim 72, further comprising agitating the fluid prior to step (a).

95. A method of using a fluid in a wellbore, comprising: (a) displacing a fluid comprising reflective particles in the wellbore; (b) detecting the reflective particles; and (c) using a video camera to observe when the fluid exits the wellbore.

* * * * *